US005239303A

United States Patent [19]

Hirotsu et al.

[11] Patent Number: 5,239,303

[45] Date of Patent: Aug. 24, 1993

[54] WIDE-BAND ANTENNA ON VEHICLE REAR WINDOW GLASS

[75] Inventors: Tohru Hirotsu; Kazuhiko Fujii; Tokio Tsukada; Shingo Tadokoro, all of Matsusaka, Japan

[73] Assignee: Central Glass Company Limited, Ube, Japan

[21] Appl. No.: 805,966

[22] Filed: Dec. 12, 1991

[30] Foreign Application Priority Data

Dec. 21, 1990 [JP] Japan ..... 2-405082

[51] Int. Cl.[5] ..... H01Q 1/32

[52] U.S. Cl. ..... 343/713; 343/704

[58] Field of Search ..... 343/713, 704

[56] References Cited

U.S. PATENT DOCUMENTS

| | | | |
|---|---|---|---|
| 4,260,989 | 4/1981 | Ishii et al. | 343/704 |
| 4,608,570 | 8/1986 | Inaba et al. | 343/713 |
| 4,954,797 | 9/1990 | Shinnai et al. | 343/704 |
| 4,967,202 | 10/1990 | Shinnai et al. | 343/713 |
| 5,101,212 | 3/1992 | Shinnai et al. | 343/704 |

FOREIGN PATENT DOCUMENTS

| | | |
|---|---|---|
| 61-121603 | 6/1986 | Japan . |
| 61-203702 | 9/1986 | Japan . |

*Primary Examiner*—Rolf Hille

*Assistant Examiner*—Hoanganh Le

*Attorney, Agent, or Firm*—Keck, Mahin & Cate

[57] ABSTRACT

The invention relates to an antenna on a vehicle rear window glass for the reception of FM radio broadcasting and TV broadcasting in both the VHF and UHF bands. The window glass is provided with defogging heater strips, and the antenna uses a space left above the heater strips. The antenna is constructed of a plurality of linear elements comprising (A) a combination of two primary elements, which are spaced from each other in the direction widthwise of the window glass and each of which has two parallel horizontal parts and at least one relatively short vertical part connecting the two horizontal parts at their ends, and a linear conductor connecting the two primary elements to each other, (B) a secondary element having a vertical part extending upward from a selected part of the combination (A) and a horizontal part extending from the upper end of the vertical part toward a side edge of the window glass and (C) a reactance element which extends downward from the extended end of the horizontal part of the secondary element (B) and makes at least two turns so as to have at least one L-shaped portion in which one leg part is parallel to another part of the reactance element. At the extended end of the reactance element (C) the antenna is connected to a feed point which is located near the side edge of the window glass.

25 Claims, 3 Drawing Sheets

WIDE-BAND ANTENNA ON VEHICLE REAR WINDOW GLASS

BACKGROUND OF THE INVENTION

This invention relates to an antenna provided to a vehicle rear window glass for receiving FM radio and television (TV) broadcast waves. The antenna is constructed of conductive strips attached to the window glass by using a space above defogging heater strips. The antenna is particularly suited to automobiles.

In the automobile industry recently attention has been paid to a so-called window glass antenna for receiving broadcast waves, and recently there is an increasing demand for a window glass antenna which can efficiently receive both FM radio broadcast waves and TV broadcast waves. To meet such a demand there are several proposals.

For example, JP 61-203702 A proposes a windshield antenna having, as an essential element, a linear element which extends vertically in the central region of the windshield, and JP 61-121603 A proposes a rear window glass antenna which is arranged in a space left above a set of defogging heater strips and includes two feed points which are connected to two different points of an antenna element, respectively.

However, generally it is unfavorable for the driver's field of view to provide an antenna in a central region of the windshield.

In the case of providing an antenna to an automobile rear window glass which needs to be provided with defogging heater strips, the antenna must be arranged in a relatively narrow space contiguous to an edge of the window glass since a central region is occupied by the heater strips. Since the allowed space is narrow and off-centered it is difficult to construct an antenna which exhibits high reception gain over a wide range of frequency including the FM radio broadcasting bands and both the VHF and UHF bands for TV broadcasting, and the difficulty still remains even though a plurality of antennas are combined so as to constitute a diversity antenna system.

SUMMARY OF THE INVENTION

Concerning a vehicle rear window glass, in particular an automobile rear window glass, which is provided with a set of defogging heater strips, it is an object of the present invention to provide a window glass antenna which can be arranged by utilizing a relatively narrow space between the defogging heater strips and the upper edge of the window glass and can receive FM radio broadcast waves and TV broadcast waves in both the VHF band and the UHF band with sufficiently high gain.

The present invention provides an antenna attached to a vehicle rear window glass for receiving FM radio broadcast waves and television broadcast waves, the window glass being provided with a set of defogging heater strips so as to leave a space between the heater strips and the upper edge of the window glass, the antenna being arranged in that space and comprising a combination of two primary elements which are connected to each other by an interconnection conductor, a secondary element, a reactance element and a feed point. The two primary elements are spaced from each other in the direction widthwise of the window glass, and each of these two elements is a linear element bent so as to have two parallel and relatively long horizontal parts and at least one relatively short vertical part which connects the two horizontal parts at their ends on the same side. The interconnection conductor is a linear element comprising a horizontal part as the major part. The secondary element is a linear element bent so as to have a first part which extends vertically from one of the two primary elements or the interconnection element toward the upper edge of the window glass and a second part which extends horizontally from the upper end of the vertical part toward a side edge of the window glass. The reactance element is a linear element which extends downward from the extended end of the horizontal second part of the secondary element and makes at least two turns so as to have at least one L-shaped portion in which one leg part is substantially parallel to another part of the reactance element.

The combination of the above stated two primary elements and the interconnection conductor serves as a wide-band antenna for the reception of FM radio broadcasting and TV broadcasting with high gains, and the above stated secondary element mainly serves the purpose of improving the directional characteristics of the antenna and further enhancing the reception gains. The insertion of the reactance element between the secondary element and the feed point facilitates to adjust the impedance of the antenna and, furthermore, has the effect of considerably improving the frequency characteristics of the antenna. When the reactance element is omitted the antenna is liable to exhibit some dips in reception gain at certain frequencies. The addition of the reactance elements almost eliminates such dips in reception gain and makes the frequency characteristics of the antenna very flat.

In this specification the term "vertical" is used in the sense of "perpendicular or nearly perpendicular to horizontal lines on the window glass". That is, a "vertical" part of any antenna element is not always literally vertical when the window glass is attached to the vehicle body.

In an antenna according to the invention each of the two primary elements may have one vertical part connecting the two horizontal parts or two vertical parts respectively connecting the two horizontal parts. In the case of having two vertical parts the primary element makes the perimeter of a horizontally elongate rectangle. In the case of having only one vertical part the primary element may be said to be in the shape of an incomplete rectangle devoid of one vertical side. In this invention it is possible to employ any of the following three combinations: combination of two elements both in the shape of an incomplete rectangle; combination of two rectangular elements; and combination of one rectangular element and one incompletely rectangular element. Usually the two primary elements are positioned on the opposite sides of the vertical center axis of the window glass, respectively, but in some cases one of the two primary elements intersects the center axis.

Usually the reactance element has a straight major part which extends downward from the end of the secondary element, and in an end portion near the feed point the reactance element makes at least two turns at approximately right angles so as to form the aforementioned L-shaped portion(s). However, also it is possible to form the L-shaped portion(s) in a middle section of the reactance element.

The essential elements of an antenna according to the invention are as stated above, and in many cases it is not necessary to add any extra element for the reception of both FM radio broadcast waves and TV broadcast waves. However, it is optional to incorporate an auxiliary element or a plurality of auxiliary elements for the purpose of improving the directional characteristics of the antenna, adjusting the impedance of the antenna and/or making capacitive coupling of the antenna with the defogging heater strips. It is possible to connect an auxiliary element to any of the two primary elements, the interconnection conductor and the secondary element, and each auxiliary element may be either straight or turning at right angles.

A vehicle window glass antenna according to the invention can be constructed in a relatively narrow area left above the defogging heater strips, and this antenna serves as a wide-band antenna which can receive FM radio broadcast waves in the 76–90 MHz band which is used mainly in Japan and the 88–108 MHz band which is used in many countries including the United States and Canada, and TV broadcast waves in both the VHF band (90–108 MHz and 170–222 MHz) and the UHF band (470–770 MHz) with satisfactory high reception gains and flat frequency characteristics. The invention is very suitable for application to automobiles.

DESCRIPTION OF THE PREFERRED EMBODIMENTS

Figure 1:
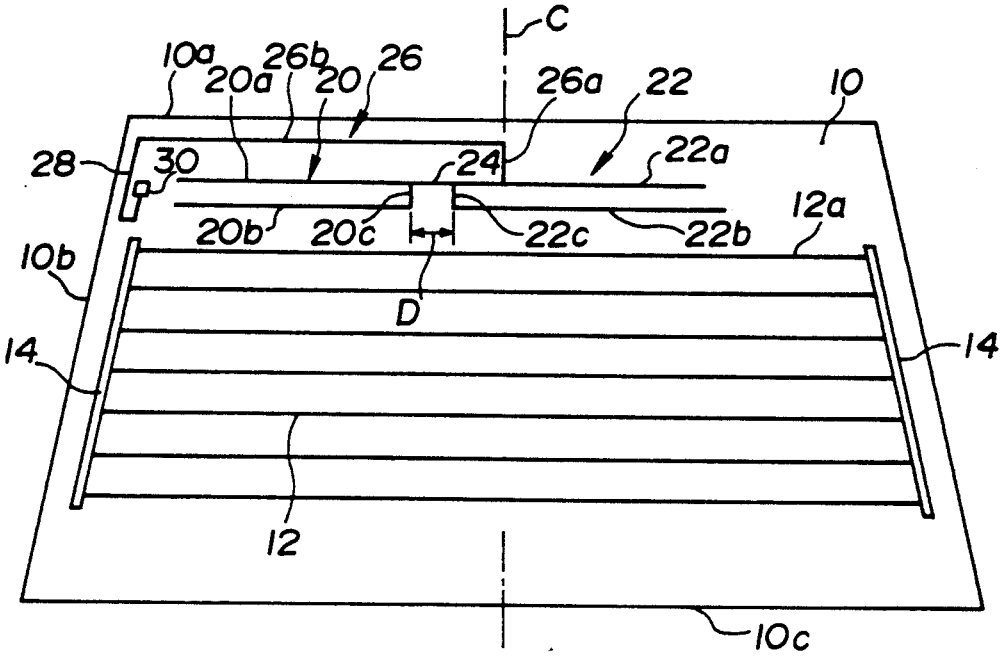
FIG. 1 is a plan view of an automobile rear window glass provided with an antenna according to the invention.

FIG. 1 shows an automobile rear window glass in which the present invention is embodied. A single piece of glass plate 10 is used as the window glass. A set of defogging heater strips 12 is disposed on the inboard surface of the window glass 10 so as to leave an open space between the upper edge 10*a* of the glass and the uppermost heater strip 12*a*. The heater strips 12 extend horizontally and connect with a pair of bus bars 14.

Using the space above the heater strips 12 an antenna according to the invnetion is disposed on the inboard surface of the window glass 10. Essentially the antenna is a combination of two primary elements 20 and 22, an interconnection conductor 24, a secondary element 26 and a reactance element 28. Every element of the antenna is a linear element made of a thin, conductive strip.

The primary element 20 is positioned between the vertical center axis C of the window glass 10 and a side edge 10*b* of the window glass. The element 20 has two parallel horizontal parts 20*a* and 20*b* and a relatively short vertical part 20*c* which connects an end of the horizontal part 20*a* to an end of the horizontal element 20*b* at a relatively short distance from the center axis C. That is, the primary element 20 approximately makes three sides of a horizontally elongate rectangle, though the two parallel horizontal parts 20*a* and 20*b* may not be equal in length. The other primary element 22 is positioned on the right-hand side of the primary element 20 so as to intersect the center axis C. The element 22 has two parallel horizontal parts 22*a* and 22*b* and a relatively short vertical part 22*c* which connects the left-hand end of the horizontal part 22*a* to the left-hand end of the horizontal part 22*b*. That is, the primary element 22 approximately makes three sides of a horizontally elongate rectangle, though in this example one of the horizontal parts 22*a*, is somewhat longer than the other. The two horizontal parts 20*a*, 20*b* of the element 20 and the two horizontal parts 22*a*, 22*b* of the element 22 are respectively in alignment.

The interconnection conductor 24 is a straight element which extends horizontaly from the upper end of the vertical part 20*c* of the primary element 20 to the upper end of the vertical part 22*c* of the primary element 22.

The secondary element 26 has a relatively short vertical part 26*a*, which extends upward from a point of the upper horizontal part 22*a* of the primary element 22, and a relatively long horizontal part 26*b* which extends in a space between the primary elements 20, 22 and the upper edge 10*a* of the window glass 10 from the upper end of the vertical part 26*a* toward the aforementioned side edge 10*b* of the window glass 10. In this example the vertical part 26*a* is on the center axis C of the window glass.

Figure 2:
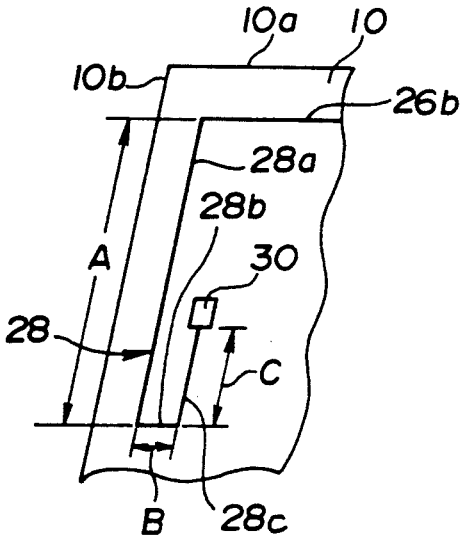
FIG. 2 is a partial enlargement of FIG. 1.

The reactance element 28 is positioned close to the side edge 10*b* of the window glass 10 and extends from the left-hand end of the horizontal part 26*b* of the secondary element 26. Referring to FIG. 2, at a short distance from the side edge 10*b* of the window glass a major part 28*a* of the reactance element 28 extends straightly downward from the horizontal part 26*b* of the secondary element 26, and this element 28 turns to the right (toward the center axis C of the window glass) to provide a short horizontal part 28*b* and then upward to provide a vertical part 28*c* which is parallel to the major part 28*a* and shorter than the major part 28*a*. The horizontal part 28*b* and the vertical part 28*c* make an L-shaped portion. At the upper end of the vertical part 28*c* the reactance element 28 is connected to the feed point 30.

Usually the heater strips 12, bus bars 14 and the antenna elements 20, 22, 24, 26, 28 and the feed point 30 are formed by printing a conductive paste onto the glass surface and, after drying, baking the glass plate with the printed paste thereon. In the case of the rear window glass using laminated glass it is also possible to embed the antenna in the laminated glass, and in that case it is optional to sandwich the antenna between two plastic interlayers by using a thin metal wire or foil as the material of the antenna elements.

In a sample of the window glass of FIG. 1 the glass plate 10 was 1180 mm in the length of the upper edge 10*a*, 1410 mm in the length of the lower edge 10*c* and 720 mm in the length perpendicular to the upper and lower edges 10*a*, 10*c*, and the dimensions of and relating to the antenna elements were as follows.

The primary element 20 was 340 mm in the length of the upper horizontal part 20*a*, 345 mm in the length of the lower horizonatal part 20*b* and 30 mm in the length of the vertical part 20*c*. The opposite primary element 22 was 345 mm in the length of the upper horizontal part 22*a*, 385 mm in the length of the lower horizontal part 22*b* and 30 mm in the length of the vertical part 22*c*. The lower part 20*b*, 22*b* of each primary element 20, 22 was at a vertical distance of 60 mm from the uppermost heater strip 12a. The length D of the interconnection conductor 24 was 50 mm. The vertical part 26a of the secondary element 26 was 50 mm long and at a horizontal distance of 50 mm from the vertical part 22c of the primary element 22, and the horizontal part 26b was 480 mm long and at a vertical distance of 20 mm from the upper edge 10a of the glass plate. Referring to FIG. 2, the reactance element 28 was 130 mm in length A, 10 mm in length B and 40 mm in length C.

With this sample, the gains of the antenna in receiving FM radio broadcast waves in the 76–90 MHz band and the 88–108 MHz band, TV broadcast waves of Nos. 1 to 12 channels in the VHF band (90–108 MHz and 170–222 MHz) and TV broadcast waves in the UHF band (470–770 MHz) were measured with respect to horizontally polarized waves and compared with the gains of a standard dipole antenna. That is, for any frequency or channel the gain of the dipole antenna was taken as the basis, 0 dB, and the gain of the sample antenna was marked on this basis. As the result, the gain of the sample antenna was −15.6 dB on an average in the FM radio band of 76–90 MHz, −14.5 dB on an average in the FM radio band of 88–108 MHz, −17.9 dB on an average in the VHF TV band and −17.5 dB on an average in the UHF TV band. Considering that a good example of conventional rear window glass antennas exhibited average gains (vs. standard dipole antenna) of about −19 dB in the 76–90 MHz band, about −20 dB in the 88–108 MHz band, about −20 dB in the VHF TV band and about −19 dB in the UHF TV band, the rear window glass antenna of FIG. 1 is judged to be a better antenna for the reception of either FM radio broadcasting or TV broadcasting in the VHF or UHF band.

Figure 3:
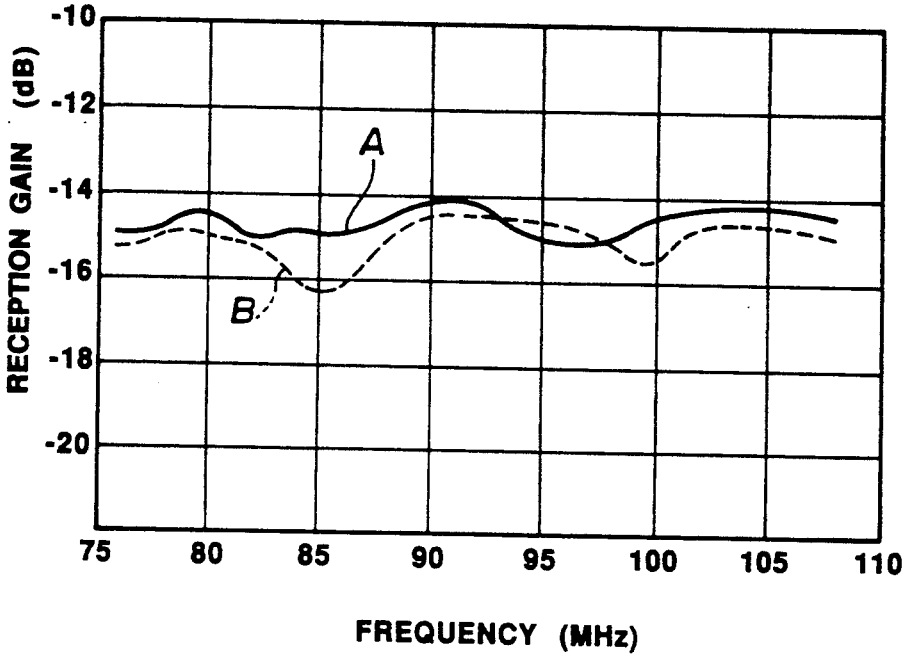
FIG. 3 is a graph showing the frequency characteristics of an example of antennas according to the invention and another antenna which lacks an important element according to the invention.

Referring to FIG. 3, over the FM radio bands of 76–108 MHz the frequency characteristic of this sample antenna was as represented by the curve A in solid line. For comparison, the sample antenna of FIG. 1 was modified by omitting the reactance element 28 and providing the feed point at the left-hand end of the horizontal part 26b of the secondary element 26. The frequency characteristic of the modified antenna was as represented by the curve B in broken line. From a comparison between the curves B and A it is apparent that the addition of the reactance element 28 renders the frequency characteristic very flat and, besides, brings about some increase in the reception gain.

Figure 4:
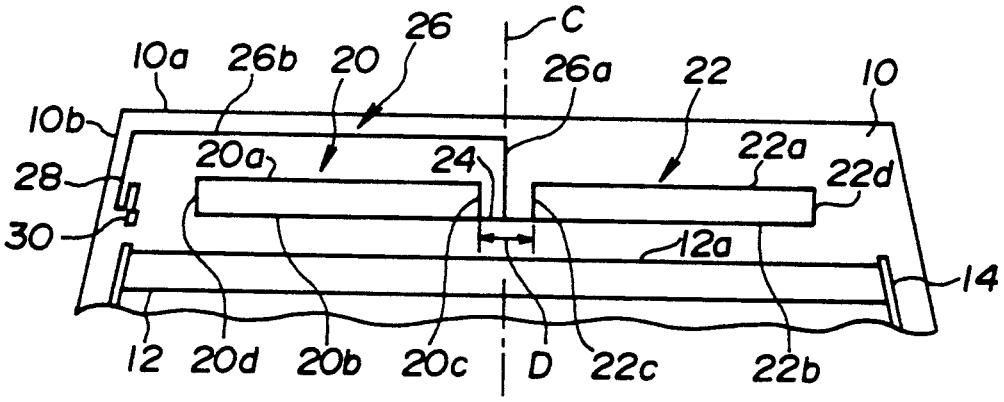
FIGS. 4, 6 and 8 respectively show three different modifications of the antenna in FIG. 1 as further examples of the invention.

FIG. 4 shows another example of the invention. In the antenna of FIG. 4 each of the two primary elements 20 and 22 makes the perimeter of a horizontally elongate rectangle. That is, the primary element 20 consists of two parallel horizontal parts 20a, 20b and two parallel vertical parts 20c, 20d which connect the two horizontal parts 20a, 20b at the opposite ends, respectively, and similarly the primary element 22 consists of two parallel horizontal parts 22a, 22b and two parallel vertical parts 22c, 22d. In this example the two primary elements 20 and 22 are identical and arranged symmetrically with respect to the center axis C of the glass plate 10. The interconnection conductor 24 is in alignment with the lower horizontal parts 20b, 22b of the two primary elements 20, 22. The secondary element 26 does not differ from the counterpart in FIG. 1, though in this example the vertical part 26a of the secondary element 26 connects to the interconnection conductor 24 because of the shift of the positions of the primary elements 20, 22.

Figure 5:
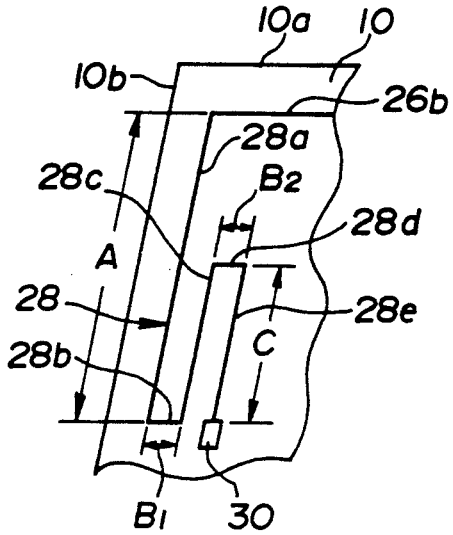
FIGS. 5 and 7 are partial enlargements of FIGS. 4 and 6, respectively.

In the antenna of FIG. 4 the reactance element 28 has increased turnings as can be seen in FIG. 5. In addition to the turnings shown in FIG. 2, this reactance element 28 further turns to the right and then downward to additionally provide a short horizontal part 28d and a nearly vertical part 28e. The feed point 30 is at the lower end of the nearly vertical part 28e. The horizontal part 28d and the vertical part 28e constitute another L-shaped portion.

In a sample of the window glass of FIG. 4 the rectangular primary element 20 was 450 mm in the length of each of the horizontal parts 20a, 20b and 40 mm in the length of each of the vertical parts 20c; 20d, and the primary element 22 on the opposite side had the same dimensions. The lower horizontal parts 20b, 22b of the two primary elements 20, 22 were at a vertical distance of 50 mm from the uppermost heater strip 12a. The length D of the interconnection conductor 24 was 100 mm, and the vertical part 26a of the secondary element 26 was at a horizontal distance of 50 mm from each of the two primary elements 20, 22. Referring to FIG. 5, the reactance element 28 was 130 mm in length A, 10 mm in both length $B_1$ and length $B_2$ and 70 mm in length C. The dimensions of the secondary element 26 and the window glass 10 were the same as in the sample of the antenna of FIG. 1.

By the test described hereinbefore, average gains (vs. standard dipole antenna) of this sample antenna were −15.1 dB in the FM radio band of 76–90 MHz, −15.8 dB in the FM radio band of 88–108 MHz, −18.1 dB in the VHF TV band and −16.8 dB in the UFH TV band. Over the FM radio bands of 76–108 MHz the frequency characteristic curve of the sample was as flat as that of the sample of the antenna of FIG. 1. That is, the antenna of FIG. 4 is nearly equivalent to the antenna of FIG. 1.

Figure 6:
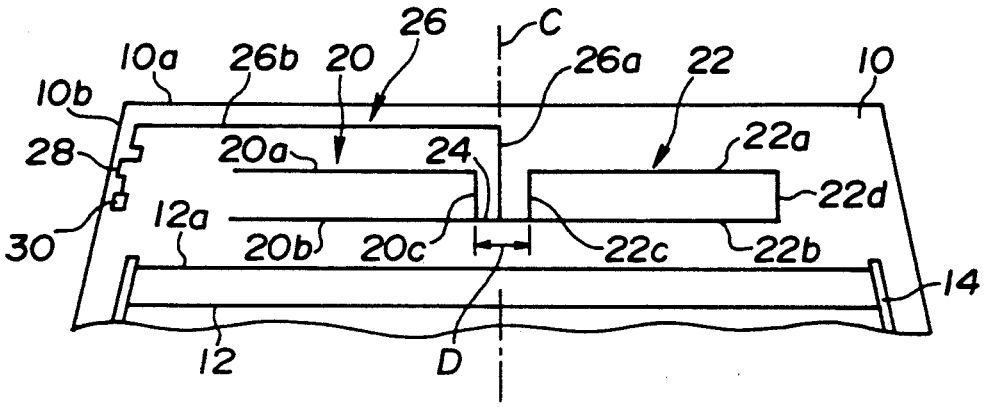
Figure 7:
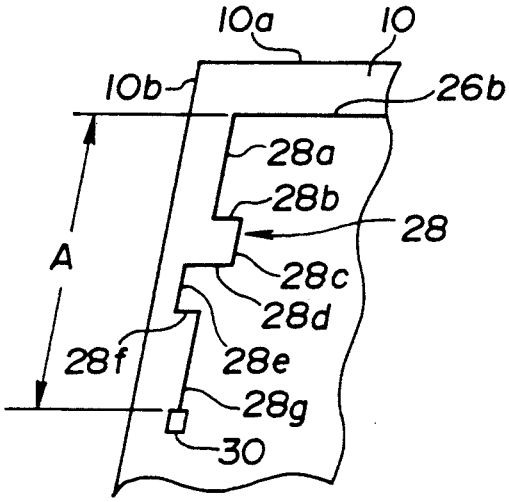

FIG. 6 shows a combination of a primary element 20 which makes only three sides of a rectangle (omission of the vertical part 20d from the primary element 20 in FIG. 4) and another primary element 22 which makes the perimeter of a rectangle. Except this change the arrangement of the two primary elements 20, 22, interconnection conductor 24 and the secondary element 26 is generally similar to that in FIG. 4. Besides, FIG. 6 shows another preferred shape of the reactance element 28. In this example the reactance element 28 makes turns in its middle section. Referring to FIG. 7, an upper end part 28a of the reactance element 28 extends straightly downward and turns to the right to provide a short horizontal part 28b, then downward to provide a short vertical part 28c, then to the left to provide a horizontal part 28d, then downward to provide a short vertical part 28e, then to the right to provide a short horizontal part 28f and then downward to provide an end part 28g which extends straightly downward. The feed point 30 is at the lower end of the straight part 28g. In this example the two straight end parts 28a and 28g are in alignment. The horizontal part 28b and the vertical part 28c make an L-shaped portion, and the horizontal part 28d and the vertical part 28e make another L-shaped portion. Further, the vertical part 28e and the horizontal part 28f make an L-shaped portion.

In a sample of the antenna of FIG. 6 each of the two primary elements 20 and 22 was 400 mm in the length of every horizontal part 20a, 20b, 22a, 22b and 50 mm in the length of every vertical part 20c, 22c, 22d, and the lower horizontal parts 20b, 22b of the two primary elements 20, 22 were at a vertical distance of 50 mm from the uppermost heater strip 12a. The length D of the interconnection conductor 24 was 100 mm, and the vertical part 26a of the secondary element 26 was at a horizontal distance of 50 mm from each of the two primary elements 20, 22. The dimensions of the secondary element 26 and the window glass 10 were the same as in the example of the antenna of FIG. 1. The reactance element 28 was 130 mm in the apparent length A in FIG. 7, 10 mm in the length of each of the horizontal parts 28b and 28f and 20 mm in the length of each of the vertical parts 28c and 28e.

By the test described hereinbefore, average gains (vs. standard dipole antenna) of this sample antenna were −15.7 dB in the FM radio band of 76–90 MHz, −16.8 dB in the FM radio band of 88–108 MHz, −17.5 dB in the VHF TV band and −17.5 dB in the UFH TV band. That is, the antenna of FIG. 6 is nearly equivalent to the antennas of FIGS. 1 and 4.

Figure 8:
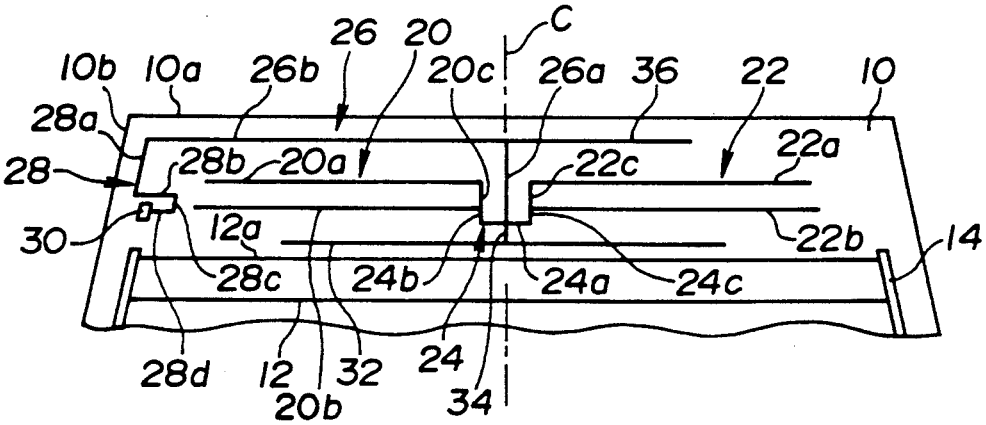

FIG. 8 shows another example of the invention. In this antenna each of the two primary elements 20, 22 has the same shape as the counterpart in FIG. 1, and the two primary elements 20 and 22 are arranged symmetrically with respect to the center axis C of the window glass. The interconnection conductor 24 is located below the primary elements 20, 22 and has a horizontal main part 24a, a short vertical part 24b which extends upward from an end of the horizontal part 24a to the lower end of the vertical part 20c of the primary element 20 and another short vertical part 24c which extends from the opposite end of the horizontal part 24a to the lower end of the vertical part 22c of the primary element 22. In other words, the interconnection conductor 24 makes three sides of a rectangle. The vertical part 26a of the secondary element 26 extends from the center point of the interconnection conductor 24. The reactance element 28 has turnings in its lower end portion. That is, a major part 28a of the reactance element 28 extends straightly downward 26 and then turns to the right to provide a horizontal part 28b, then downward to provide a short vertical part 28c and then to the left to provide a short horizontal part 28d which extends to the feed point 30. The horizontal part 28b and the vertical part 28c make an L-shaped portion, and, further, the vertical part 28c and the horizontal part 28d make an L-shaped portion.

In addition, the antenna of FIG. 8 includes an auxiliary element 32 which is located below the two primary elements 20, 22 and the interconnection element 24 and extends horizontally at a short distance from the uppermost heater strip 12a, a short connection line 34 which extends vertically from a middle point of the auxiliary element 32 to a middle point of the interconnection conductor 24, and another auxiliary element 36 which extends horizontally from the upper end of the vertical part 26a of the secondary element 26 in the direction opposite to the horizontal part 26b of the secondary element 26.

The antenna of FIG. 8 also proved to be nearly equivalent to the antennas of FIGS. 1, 4 and 6 in the reception gains for FM radio broadcasting and TV broadcasting in the VHF and UHF bands.

As represented by the foregoing embodiments, each of the two primary elements 20 and 22 of an antenna according to the invention makes either the perimeter of a horizontally elongate rectangle or two horizontal sides and one vertical side of a horizontally elongate rectangle, and in the latter case it is permissible that the two horizontal sides are slightly different in length. It is possible to choose any of the three kinds of combinations, viz. combination of two rectangles, combination of two incomplete rectangles (each devoid of one vertical side) and combination of one rectangle and one incomplete rectangle. The choice is made according to the type of the vehicle to which the antenna is to be provided and the frequency range of broadcast waves to be received most frequently. In general it is suitable to determine the length of each horizontal part 20a, 20b, 22a, 22b of each primary element 20, 22 within the range from 200 to 800 mm, and preferably in the range from 300 to 700 mm, and the length of each vertical part 20c, 20d, 22c, 22d within the range from 5 to 60 mm, and preferably in the range from 10 to 50 mm.

The interconnection conductor 24 is either a straight and horizontally extending element or a bent element which makes three sides of a rectangle and has a horizontal part. In either case it is suitable that the horizontal length of the element 24 is in the range from 10 to 150 mm, and preferably in the range from 40 to 100 mm. In the case of the bent conductor 24 it is permissible that each of the two vertical parts makes turns in an end portion thereof.

As to the secondary element 26, usually it is suitable to determine the length of the vertical part 26a within the range from 20 to 150 mm, and preferably in the range from 30 to 100 mm, and the length of the horizontal part 26b within the range from 400 to 800 mm, and preferably in the range from 500 to 700 mm.

As to the reactance element 28, at least an upper end portion of this element extends straightly downward, and it is necessary that this element makes at least two turns so as to have at least one L-shaped portion in which one leg part extends parallel to another part of the element 26. As illustrated in FIG. 4 (and FIG. 5) and FIG. 6 (and FIG. 7), according to the type of the vehicle the reactance element 28 may make several turns so as to have two or more L-shaped portions. In any case it is suitable to determine the length of each leg part of the L-shaped portion(s), e.g., each of length B and length C in FIG. 2, within the range from 5 to 100 mm, and preferably in the range from 10 to 80 mm.

A window glass antenna according to the invention is fully practicable by itself. However, it is optional, and rather preferable in some cases, to construct a diversity antenna system for the reception of FM radio broadcasting and TV broadcasting by combining an antenna according to the invention with another window glass antenna, which may be provided to the vehicle rear window glass by utilizing the space below the heater strips or another window of the vehicle, or a conventional antenna such as a pole antenna.

What is claimed is:

1. An antenna attached to a vehicle rear window glass for receiving FM radio broadcast waves and television broadcast waves, the window glass being provided with a set of defogging heater strips so as to leave a space between the heater strips and the upper edge of the window glass, the antenna being arranged in said space and consisting essentially of:

a combination of two primary elements each of which is a linear element spaced from the other in the direction widthwise of the window glass and is bent so as to have only two parallel and relatively long horizontal parts and at least one relatively short vertical part which connects an end of one of said horizontal parts to an end of the other horizontal part and a linear inter-connection conductor which extends at least partly horizontally and connects said two primary elements to each other;

a secondary element which is a linear element bent so as to have a first part which extends vertically from a selected part of said combination toward the upper edge of the window glass and a second part which extends horizontally from the upper end of said first part toward a side edge of the window glass at a shorter distance from the upper edge of the window glass than the distance of any part of said combination from said upper edge;

a reactance element which is a linear element extending downward from the extended end of said second part of said secondary element, said reactance element making at least two turns so as to have at least one L-shaped portion in which one leg part is substantially parallel to another part of the reactance element; and a feed point located in a marginal region of said space contiguous to said side edge of the window glass, the extended end of said reactance element being connected to said feed point.

2. An antenna according to claim 1, wherein each of said two primary elements has only one vertical part connecting said two horizontal parts.

3. An antenna according to claim 2, wherein the horizontal distance of each of said two primary elements from a vertical center axis of the window glass becomes minimum at said vertical part.

4. An antenna according to claim 1, wherein each of said two primary elements has two vertical parts respectively connecting said two horizontal parts and makes the perimeter of a horizontally elongate rectangle.

5. An antenna according to claim 1, wherein one of said two primary elements has only one vertical element connecting said two horizontal parts, whereas the other primary element has two vertical parts respectively connecting said two horizontal parts and makes a horizontally elongate rectangle.

6. An antenna according to claim 5, wherein the horizontal distance between said two primary elements becomes minimum at said one vertical part.

7. An antenna according to claim 1, wherein one of said two primary elements is positioned between a vertical center axis of the window glass and said side edge of the window glass and the other is positioned between said center axis and the opposite side edge of the window glass.

8. An antenna according to claim 1, wherein one of said two primary elements is positioned so as to intersect a vertical center axis of the window glass.

9. An antenna according to claim 1, wherein said two horizontal parts of one of said two primary elements and said two horizontal parts of the other primary element are horizontally in alignment, respectively.

10. An antenna according to claim 1, wherein said interconnection conductor has a horizontal middle part and two substantially vertical end parts which are connected to said two primary elements, respectively.

11. An antenna according to claim 1, wherein said reactance element makes said at least two turns in an end portion thereof remote from said second part of said secondary element.

12. An antenna according to claim 1, wherein said reactance element makes said at least two turns in a middle portion thereof.

13. An antenna according to claim 1, wherein each of said two primary elements is 200 to 800 mm in the length of each of said two horizontal parts and 5 to 60 mm in the length of said at least one vertical part.

14. An antenna according to claim 13, wherein the length of each of said two horizontal parts is 300 to 700 mm.

15. An antenna according to claim 13, wherein the length of said at least one vertical part is 10 to 50 mm.

16. An antenna according to claim 13, wherein the horizontal distance between said two primary elements is 10 to 150 mm.

17. An antenna according to claim 16, wherein said horizontal distance is 40 to 100 mm.

18. An antenna according to claim 13, wherein said secondary element is 20 to 150 mm in the length of said first part and 400 to 800 mm in the length of said second part.

19. An antenna according to claim 18, wherein the length of said first part is 30 to 100 mm and the length of said second part is 500 to 700 mm.

20. An antenna according to claim 13, wherein in said reactance element the length of each leg part of said at least one L-shaped portion is 5 to 100 mm.

21. An antenna according to claim 20, wherein the length of said each leg part is 10 to 80 mm.

22. An antenna according to claim 1, wherein said window glass is an automobile rear window glass.

23. An antenna attached to a vehicle rear window glass for receiving FM radio broadcast waves and television broadcast waves, the window glass being provided with a set of defogging heater strips so as to leave a space between the heater strips and the upper edge of the window glass, the antenna being arranged in said space and consisting essentially of:

a combination of two primary elements each of which is a linear element spaced from the other in the direction widthwise of the window glass and is bent so as to have only two parallel and relatively long horizontal parts and at least one relatively short vertical part which connects an end of one of said horizontal parts to an end of the other horizontal part and a linear inter-connection conductor which extends at least partly horizontally and connects said two primary elements to each other;

a secondary element which is a linear element bent so as to have a first part which extends vertically from a selected part of said combination toward the upper edge of the window glass and a second part which extends horizontally from the upper end of said first part toward a side edge of the window glass at a shorter distance from the upper edge of the window glass than the distance of any part of said combination from said upper edge;

a reactance element which is a linear element extending downward from the extended end of said second part of said secondary element, said reactance element making at least two turns so as to have at least one L-shaped portion in which one leg part is substantially parallel to another part of the reactance element; and a feed point located in a marginal region of said space contiguous to said side edge of the window glass, the extended end of said reactance element being connected to said feed point;

said antenna further comprising an auxiliary element which is a linear element comprising a single horizontal part and is connected to a selected part of said combination.

24. An antenna attached to a vehicle rear window glass for receiving FM radio broadcast waves and televison broadcast waves, the window glass being provided with a set of defogging heater strips so as to leave a space between the heater strips and the upper edge of the window glass, the antenna being arranged in said space and consisting essentially of:

a combination of two primary elements each of which is a linear element spaced from the other in the direction widthwise of the window glass and is bent so as to have only two parallel and relatively long horizontal parts and at least one relatively short vertical part which connects an end of one of said horizontal parts to an end of the other horizontal part and a linear inter-connection conductor which extends at least partly horizontally and connects said two primary elements to each other;

a secondary element which is a linear element bent so as to have a first part which extends vertically from a selected part of said combination toward the upper edge of the window glass and a second part which extends horizontally from the upper end of said first part toward a side edge of the window glass at a shorter distance from the upper edge of the window glass than the distance of any part of said combination from said upper edge;

a reactance element which is a linear element extending downward from the extended end of said second part of said secondary element, said reactance element making at least two turns so as to have at least one L-shaped portion in which one leg part is substantially parallel to another part of the reactance element; and a feed point located in a marginal region of said space contiguous to said side edge of the window glass, the extended end of said reactance element being connected to said feed point;

said antenna further comprising an auxiliary element which is a linear element comprising a horizontal part which extends from a point of said first part of said secondary element.

25. An antenna attached to a vehicle rear window glass for receiving FM radio broadcast waves and television broadcast waves, the window glass being provided with a set of defogging heater strips so as to leave a space between the heater strips and the upper edge of the window glass, the antenna being arranged in said space and consisting essentially of:

a combination of two primary elements each of which is a linear element spaced from the other in the direction widthwise of the window glass and is bent so as to have only two parallel and relatively long horizontal parts and at least one relatively short vertical part which connects an end of one of said horizontal parts to an end of the other horizontal part and a linear inter-connection conductor which extends at least partly horizontally and connects said two primary elements to each other;

a secondary element which is a linear element bent so as to have a first part which extends vertically from a selected part of said combination toward the upper edge of the window glass and a second part which extends horizontally from the upper end of said first part toward a side edge of the window glass at a shorter distance from the upper edge of the window glass than the distance of any part of said combination from said upper edge;

a reactance element which is a linear element extending downward from the extended end of said second part of said secondary element, said reactance element making at least two turns so as to have at least one L-shaped portion in which one leg part is substantially parallel to another part of the reactance element; and a feed point located in a marginal region of said space contiguous to said side edge of the window glass, the extended end of said reactance element being connected to said feed point;

said antenna further comprising an auxiliary element which is a linear element comprising a single horizontal part connected to a selected part of said combination and which extends from a point on said first part of said secondary element.

* * * * *